US009518439B2

(12) United States Patent
Hallundbæk et al.

(10) Patent No.: US 9,518,439 B2
(45) Date of Patent: Dec. 13, 2016

(54) ANNULAR BARRIER WITH A SELF-ACTUATED DEVICE

(71) Applicant: WELLTEC A/S, Allerød (DK)

(72) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 211 days.

(21) Appl. No.: 14/363,864

(22) PCT Filed: Dec. 20, 2012

(86) PCT No.: PCT/EP2012/076290
§ 371 (c)(1),
(2) Date: Jun. 9, 2014

(87) PCT Pub. No.: WO2013/092805
PCT Pub. Date: Jun. 27, 2013

(65) Prior Publication Data

US 2014/0352942 A1 Dec. 4, 2014

(30) Foreign Application Priority Data

Dec. 21, 2011 (EP) ..... 11194954

(51) Int. Cl.
*E21B 33/127* (2006.01)
*E21B 34/08* (2006.01)
(Continued)

(52) U.S. Cl.
CPC ..... *E21B 33/127* (2013.01); *E21B 33/122* (2013.01); *E21B 34/06* (2013.01); *E21B 34/08* (2013.01); *E21B 34/102* (2013.01)

(58) Field of Classification Search
CPC ..... E21B 33/12; E21B 33/127; E21B 33/122; E21B 34/08; E21B 34/06; E21B 34/102; E21B 34/10
See application file for complete search history.

(56) References Cited

U.S. PATENT DOCUMENTS 2,745,496 A * 5/1956 Blood ..... E21B 33/127 166/152
2,942,667 A * 6/1960 Bridwell ..... E21B 21/00 166/187
(Continued)

FOREIGN PATENT DOCUMENTS

CN 102272413 A 12/2011
EP 0 214 851 3/1987
(Continued)

OTHER PUBLICATIONS

International Search Report for PCT/EP2012/076290 mailed Feb. 19, 2013.
(Continued)

*Primary Examiner* — Yong-Suk (Philip) Ro
(74) *Attorney, Agent, or Firm* — Nixon & Vanderhye P.C.

(57) ABSTRACT

An annular barrier to be expanded in an annulus between a well tubular structure and an inside wall of a borehole downhole, includes a tubular part for mounting as part of the well tubular structure. The tubular part has a longitudinal axis, an expandable sleeve surrounding the tubular part and having an outer face, each end of the expandable sleeve being fastened to the tubular part by a connection part, an annual barrier space between the tubular part and the expandable sleeve, an aperture in the tubular part or the connection part for letting fluid into the space in order to expand the sleeve, and a self-actuated device arranged in the aperture having an open and a closed position.

20 Claims, 9 Drawing Sheets

(51) Int. Cl.

| | |
|---|---|
| ***E21B 34/10*** | (2006.01) |
| ***E21B 33/122*** | (2006.01) |
| ***E21B 34/06*** | (2006.01) |

(56) References Cited

U.S. PATENT DOCUMENTS

| | | | | | |
|---|---|---|---|---|---|
| 3,272,517 | A | * | 9/1966 | Howard | E21B 33/1208 277/333 |
| 3,291,219 | A | | 12/1966 | Nutter | |
| 3,422,673 | A | * | 1/1969 | Lebourg | E21B 33/127 166/187 |
| 3,441,095 | A | * | 4/1969 | Youmans | E21B 7/007 175/4.52 |
| 3,524,503 | A | | 8/1970 | Baker | |
| 3,666,011 | A | * | 5/1972 | Owens | E21B 33/134 166/187 |
| 3,818,986 | A | * | 6/1974 | Abney | E21B 33/12 166/143 |
| 4,260,164 | A | * | 4/1981 | Baker | E21B 33/127 137/461 |
| 4,424,861 | A | | 1/1984 | Carter et al. | |
| 4,577,695 | A | | 3/1986 | Wood | |
| 4,711,301 | A | | 12/1987 | Stringfellow | |
| 5,400,855 | A | | 3/1995 | Stepp et al. | |
| 5,443,124 | A | * | 8/1995 | Wood | E21B 33/124 166/319 |
| 2004/0256114 | A1 | | 12/2004 | Coronado | |
| 2014/0145402 | A1 | * | 5/2014 | Hallundbæk | E21B 33/12 277/334 |
| 2014/0311751 | A1 | | 10/2014 | Hallundbæk et al. | |

FOREIGN PATENT DOCUMENTS

| | | | |
|---|---|---|---|
| RU | 105350 | U1 | 6/2011 |
| SU | 448272 | A1 | 10/1974 |
| SU | 648715 | A1 | 2/1979 |
| SU | 684131 | A1 | 9/1979 |
| SU | 840286 | A1 | 3/1987 |
| WO | WO 91/05134 | | 4/1991 |
| WO | WO 2004/046500 | | 6/2004 |

OTHER PUBLICATIONS

Written Opinion of the ISA for PCT/EP2012/076290 mailed Feb. 19, 2013.

International Preliminary Report on Patentability mailed Jul. 3, 2014 in International Application No. PCT/EP2012/076290 (8 pages).

Chinese Office Action mailed Apr. 6, 2016 in Chinese Application No. 201280060306.5, with English Translation (12 pages).

Decision on Patent Grant for Invention dated Aug. 10, 2016 issued in Russian Application No. 2014126733 with English translation (16 pages).

* cited by examiner

ANNULAR BARRIER WITH A SELF-ACTUATED DEVICE

This application is the U.S. national phase of International Application No. PCT/EP2012/076290 filed 20 Dec. 2012 which designated the U.S. and claims priority to EP Patent Application No. 11194954.1 filed 21 Dec. 2011, the entire contents of each of which are hereby incorporated by reference.

FIELD OF THE INVENTION

The present invention relates to an annular barrier to be expanded in an annulus between a well tubular structure and an inside wall of a borehole downhole. Furthermore, the invention relates to a downhole system.

BACKGROUND ART

In wellbores, annular barriers are used for different purposes, such as for providing a barrier to flow within an annulus, from above and below the annular barrier. The annular barriers are mounted as part of the well tubular structure. An annular barrier has an inner wall surrounded by an annular expandable sleeve. The expandable sleeve is typically made of a metallic material, but may also be made of an elastomeric material. The sleeve is fastened at its ends to the inner wall of the annular barrier.

In order to create zones within the annulus, a second and subsequent annular barrier can be used. The first annular barrier is expanded at one side of the zone to be sealed off and the second and subsequent annular barrier is expanded. Thus, several zones are created and sealed off from each other.

The pressure envelope of a well is governed by the burst rating of the tubular and the well hardware etc. used within the well construction. In some circumstances, the expandable sleeve of an annular barrier is expanded by increasing the pressure within the tubular structure of the well, which is the most cost-efficient way of expanding the sleeve.

When expanding the expandable sleeve of an annular barrier by pressurising the tubular structure from within, several annular barriers are expanded simultaneously. However, if one expandable sleeve cracks or develops a leak, fluid is let into the annulus and then the pressure drops in the tubular structure, and further expansion of the annular barriers stops. The operator then has to isolate the annular barrier having a crack in the expandable sleeve before being capable of continuing the expansion of the rest of the annular barriers.

The expandable sleeve may crack or leak for a number of reasons, e.g. due to defects in the material, damage during manufacturing, scratch or wear during deployment, etc.

SUMMARY OF THE INVENTION

It is an object of the present invention to wholly or partly overcome the above disadvantages and drawbacks of the prior art. More specifically, it is an object to provide an improved annular barrier system in which a crack or leak created during expansion of one annular barrier does not hinder the expansion of the other annular barriers when expanded.

The above objects, together with numerous other objects, advantages, and features, which will become evident from the below description, are accomplished by a solution in accordance with the present invention by an annular barrier to be expanded in an annulus between a well tubular structure and an inside wall of a borehole downhole, comprising a tubular part for mounting as part of the well tubular structure, said tubular part having a longitudinal axis, an expandable sleeve surrounding the tubular part and having an outer face, each end of the expandable sleeve being fastened to the tubular part by means of a connection part, an annual barrier space between the tubular part and the expandable sleeve, an aperture in the tubular part or the connection part for letting fluid into the space in order to expand the sleeve, and a self-actuated device arranged in the aperture having an open and a closed position.

The self-actuated device may comprise a housing having an outlet opening and an inlet opening, a closing member and a spring member arranged to force the self-actuated device in the open position, so that fluid let into the space is capable of flowing in through the inlet opening and out through the outlet opening into the space.

Also, the self-actuated device may comprise at least one projectable element to lock the closing member when the closing member is in the closed position of the device, preventing the closing member from returning to the open position.

Moreover, the spring member may be a spring, such as a helical spring.

Further, the spring member may be an elastomeric element or a rubber element.

In one embodiment the self-actuated device may close when a flow rate of fluid through the device exceeds a predetermined flow rate.

In another embodiment, the self-actuated device may close when a pressure of fluid through the device drops below a predetermined level.

In yet another embodiment, the self-actuated device may close when a predetermined volume of fluid passes through the self-actuated device.

Furthermore, the spring member may be arranged between the outlet opening and the closing member.

In one embodiment, the self-actuated device may have an indication of a position of the closing member.

Further, at least one of the connection parts may be slideable in relation to the tubular part.

Also, at least one of the connection parts may be fixedly connected with the tubular part.

In one embodiment, the device may be a valve.

Moreover, the self-actuated device may be a valve such as an excess-flow check valve, a mechanical valve closing at a flow rate higher than a predetermined flow rate, a shut-off valve, or a differential pressure shut-off valve.

Said closing member may comprise a rod or shaft penetrating a partition in the housing of the valve, the rod may end in an end member and the spring member may be arranged between the partition and the end member.

In one embodiment, the self-actuated device may further comprise a pressure sensor arranged in the space in order to close the outlet opening of the valve when the pressure of the fluid drops below a predetermined level.

In addition, the annular barrier as described above may further comprise a sensor arranged on the outer face of the expandable sleeve.

In an embodiment, the sensor may be a sound detection sensor.

Also, the sensor may be wirelessly connected with the self-actuated device.

Furthermore, the self-actuated device may comprise a second bore having a compensating piston.

The spring member may be arranged to force the closing member towards or away from the outlet opening in the open position of the self-actuated device, so that fluid let into the space is capable of flowing in through the inlet opening and out through the outlet opening into the space.

Moreover, the projectable element may engage a groove in the closing member or the housing for locking the closing member.

Additionally, the projectable element may engage an end face of a partition for locking the closing member.

Furthermore, the present invention relates to a downhole system comprising a plurality of annular barriers according to the invention.

Said system may further comprise a detection tool for determining the position of the device after expansion of the annular barrier.

In one embodiment, the tool may comprise a pressure sensor.

In another embodiment, tool may comprise a capacitance measuring unit.

In yet another embodiment, the tool may comprise a driving unit, such as a downhole tractor.

Further the downhole system according to the invention may comprise the well tubular structure having a valve section arranged between two annular barriers in order to let hydrocarbon-containing fluid into the well tubular structure.

Finally, the tool may comprise replacement means for replacing the device in the annular barrier.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
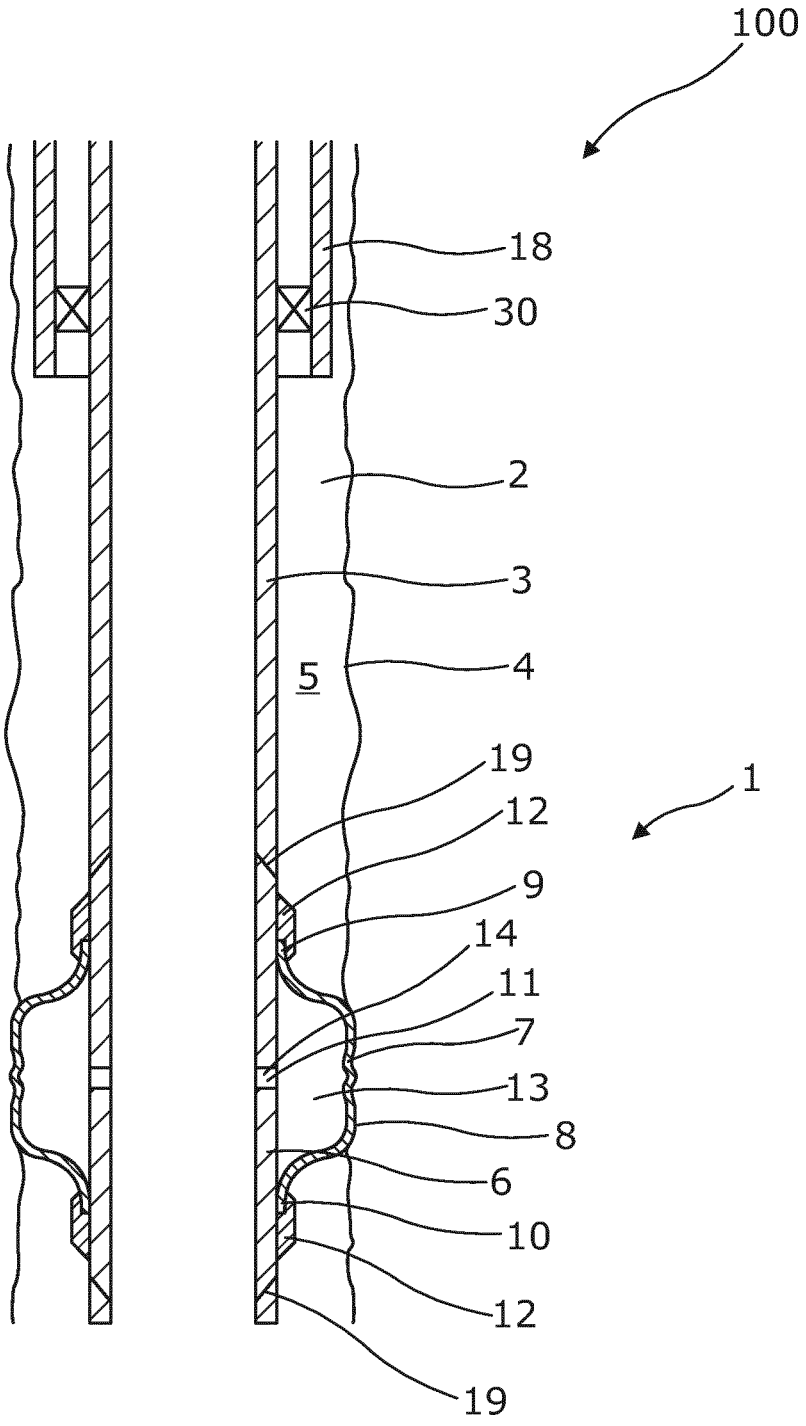
FIG. 1 shows an annular barrier being part of a well tubular structure in an expanded condition of the annular barrier.

FIG. 1 shows an annular barrier 1 expanded in an annulus 2 between a well tubular structure 3 and an inside wall 4 of a borehole 5 downhole. The annular barrier 1 comprises a tubular part 6 which has been mounted as part of the well tubular structure 3 by means of a threaded connection 19. The annular barrier 1 comprises an expandable sleeve 7 surrounding the tubular part 6 and having an outer face 8 which, in an expanded condition of the annular barrier 1, abuts the inside wall 4 of the borehole 5. Each end 9, 10 of the expandable sleeve 7 is fastened to the tubular part 6 by means of a connection part 12. The expandable sleeve 7 surrounds the tubular part 6, forming an annual barrier space 13 therebetween. An aperture 11 is arranged in the tubular part 6 through which fluid is let into the space 13 to expand the sleeve 7, thus providing an annular isolation between the well tubular structure 3 and the borehole 5. When expanding the expandable sleeve 7, the well tubular structure 3 is pressurised with fluid from the top of the well, and the pressurised fluid is thus forced into the space to expand the expandable sleeve 7.

One connection part or both connection parts 12 may be sliding in relation to the tubular part 6, and the other may be fixedly connected with the tubular part 6. Annular barriers 1 may also be arranged to provide a seal between two tubular structures, such as an intermediate casing 18 and a production casing 3, instead of another kind of packer 30.

Furthermore, the annular barrier 1 comprises a self-actuated device 14 which is arranged in the aperture 11 and has an open and a closed position. When in the open position, fluid is let into the space 13, and when in the closed position, the fluid can no longer pass through the device into the space. By having a self-actuated device 14, the aperture 11 of the tubular part 6 of the annular barrier 1 can be closed if a fracture in the expandable sleeve 7 occurs during expansion of the annular barrier 1. When the expandable sleeve 7 fractures, the pressure inside the space 13 of the annular barrier 1 drops to the pressure in the annulus and thus more fluid is let into the space 13. When such substantial change occurs, the device closes at a predetermined level and no more fluid is let into the space 13 of the annular barrier 1. Hereby, the pressurisation of the well tubular structure 3 can continue expanding the expandable sleeves 7 of the remaining annular barriers 1.

The self-actuated device 14 may be a valve or a similar device capable of closing in order to stop a flow of fluid. Thus, the self-actuated device functions as a self-actuated safety valve.

Figure 2:
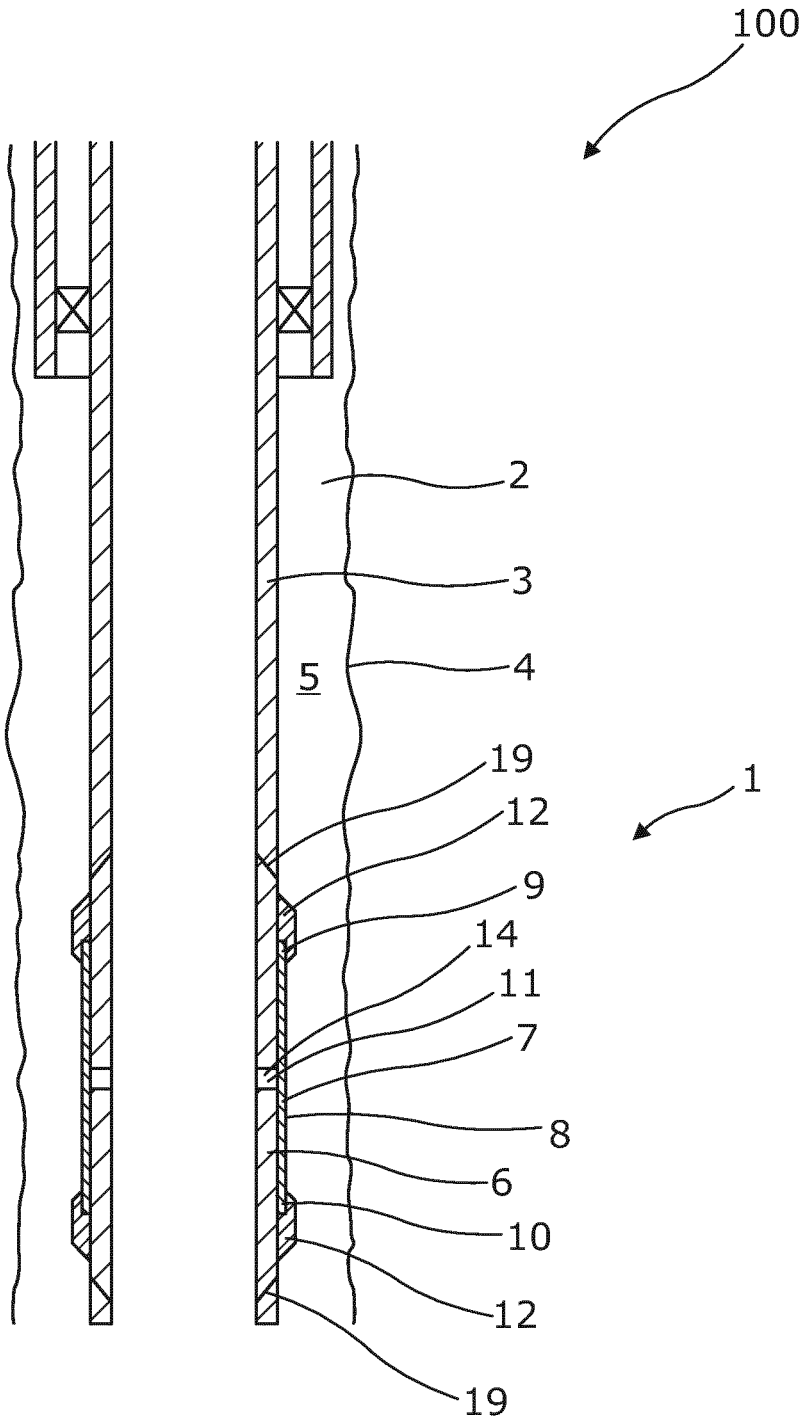
FIG. 2 shows the annular barrier of FIG. 1 in an unexpanded condition.

In FIG. 1, the expandable sleeve 7 is shown in its expanded condition and in FIG. 2, the same annular barrier 1 is shown before expansion thereof.

Figure 3A:
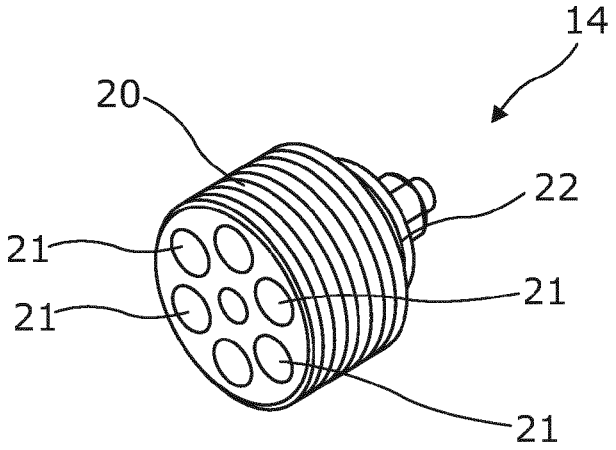
FIG. 3*a* shows a self-actuated device in perspective.
Figure 3B:
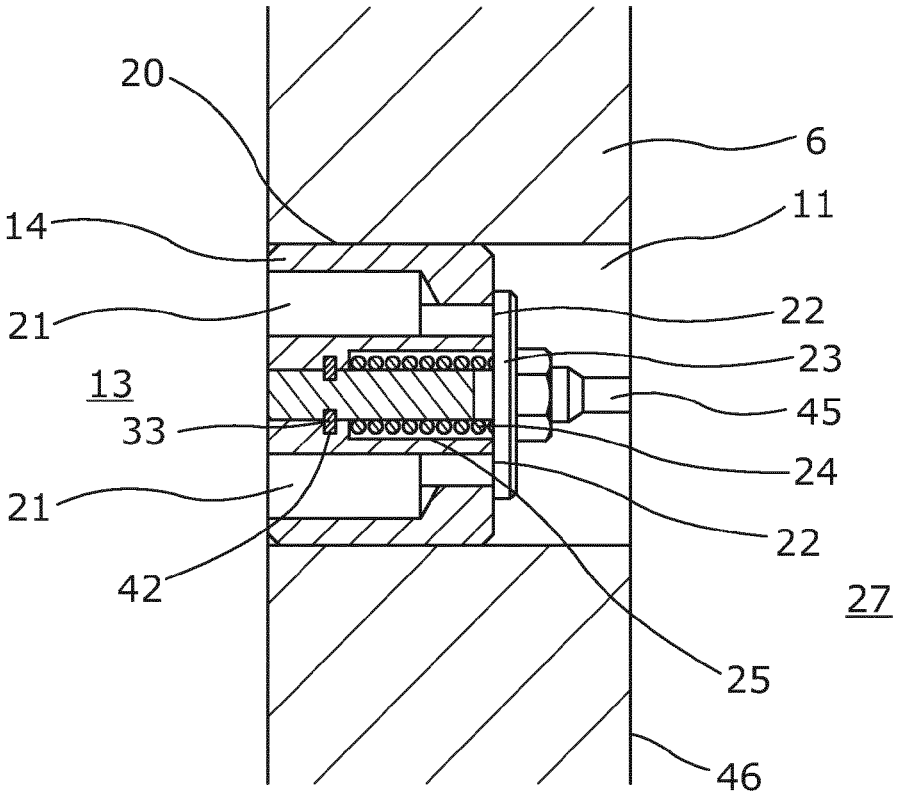
FIG. 3*b* shows a cross-sectional view of the device of FIG. 3*a* in a closed position.
Figure 3C:
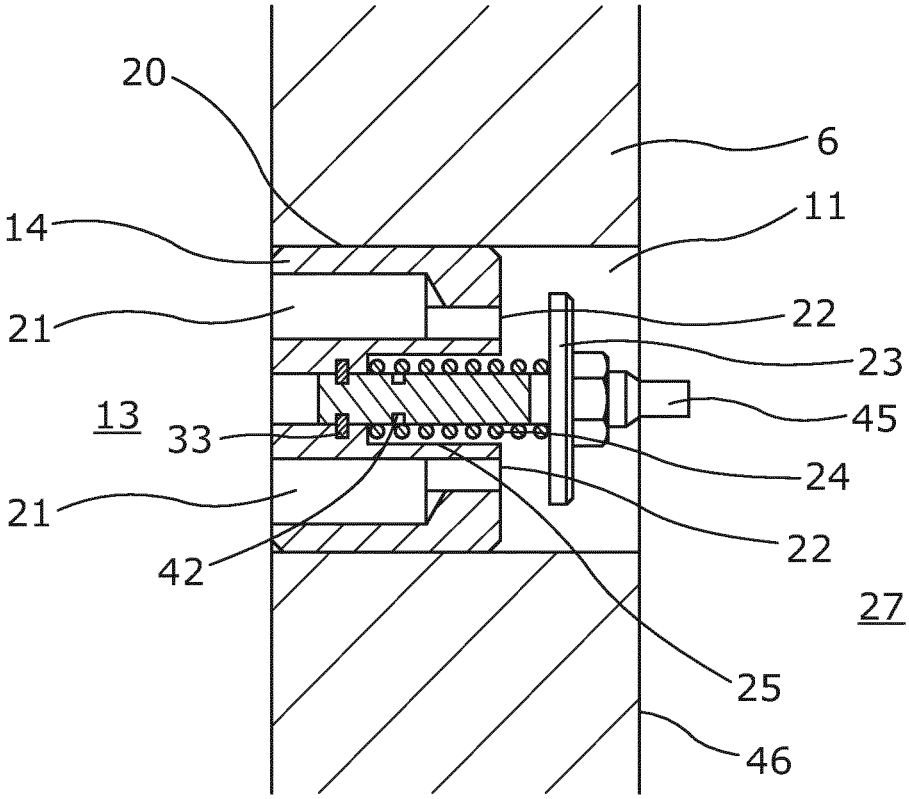
FIG. 3*c* shows a cross-sectional view of the device of FIG. 3*a* in an open position.

Thus, the self-actuated device 14 closes when a flow rate of fluid therethrough exceeds a predetermined flow rate or when a pressure of fluid therethrough drops below a predetermined level. In FIG. 3*a*, the self-actuated device 14 comprising a housing 20 having six outlet openings 21 is shown. In FIG. 3*b*, the device 14 of FIG. 3*a* is shown in cross-section with an inlet opening 22, a closing member 23 and a spring member 24 in its closed position. The spring member 24 is arranged in a bore 25 of the housing 20. In FIG. 3*c*, the device 14 is shown in its open position in which the spring member 24 presses against the closing member 23, forcing the closing member 23 away from the outlet opening 21, so that fluid is capable of flowing in through the inlet opening 22 and out through the outlet opening 21 into the space 13. When the annular barrier is inserted in the well, the self-actuated device 14 is in the open position, ready for fluid to enter into the space and expand the expandable sleeve. The device of FIGS. 3*a-c* is used in the event of a burst or a leak in the sleeve to shut off further passage of the fluid in the space. In order for the self-actuated device to close, the pressure has to surmount the spring force inherent in the spring member. The self-actuated device comprises projectable elements 33 which are kept in the unprojected position, as shown in FIG. 3*c*, until the closing member 23 moves into the closed position in which the projectable elements 33 engage a groove 42, and thus the closing member 23 is prevented from returning to the open position. In the event of a burst in the expandable sleeve, the self-actuated device closes and is locked by the projectable elements 33 and is thus prevented from opening again, and the pressurised fluid from within the tubular structure is prevented from accessing the annulus. In the event of a burst, the expansion of the other annular barriers may continue when the self-actuated device has closed off the burst annular barrier.

In FIG. 3*a*, the device 14 is shown in the form of a cartridge which is very easy to mount in the aperture of the annular barrier. As can be seen in FIG. 3*a*, the housing 20 has external threading for mounting into the aperture of the tubular part of the annular barrier.

Figure 4A:
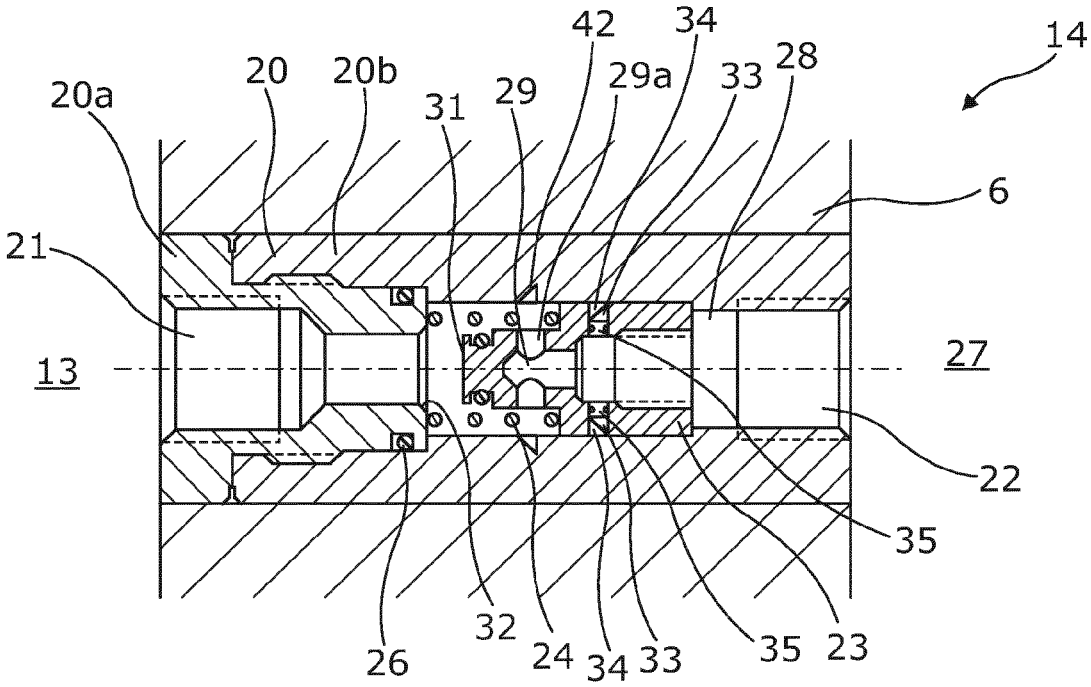
FIG. 4*a* shows a cross-sectional view of another embodiment of the device in an open position.
Figure 4B:
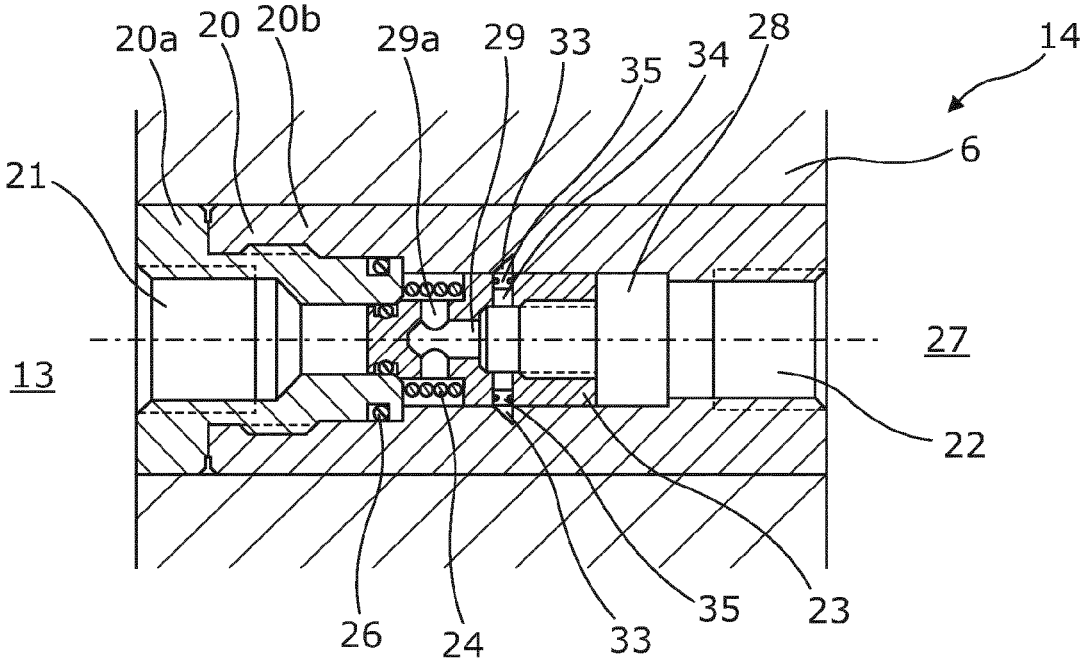
FIG. 4*b* shows a cross-sectional view of the device of FIG. 4*a* in a closed position.

In FIGS. 4*a* and 4*b*, the housing 20 comprises two housing parts 20*a*, 20*b* threadedly connected to form the housing 20. The first housing part 20*a* is screwed into a bore of the second housing part 20*b*, and in order to provide a sealed connection, the first housing part 20*a* comprises a circumferential sealing element 26. The housing 20 has an outlet opening 21 facing the expandable sleeve 7 and thus the space 13. The inlet opening 22 of the housing 20 faces the interior 27 of the tubular part 6 and thus the inside of the well tubular structure 3. In FIG. 4*a*, the device is shown in its open position, in which the closing member 23 is arranged in a bore 28 and forced away from the outlet opening 21 by a spring member 24 arranged between the opening and the closing member 23. The pressurised fluid flows in through the inlet opening 22 through a central bore 29 in the closing member 23 and out through side channels 29*a* to the central bore 29 and past the front end 31 of the closing member 23. After passing the front end 31, the fluid flows out into the space 13 through the outlet opening 21.

When the pressure drops in the space 13 due to a leak in the expandable sleeve, the fluid pressure surmounts the spring force of the spring member 24 and forces the closing member 23 to seat against a seat 32 in the housing 20 and thus closes off the fluid communication between the interior 27 of the tubular part 6 and the space 13. The front end 31 of the closing member 23 has a circumferential sealing element 26 to tighten against an inner surface of the bore into which the closing member extends when in its closed position.

In order to prevent the device from returning to the open position when in the closed position, the closing member 23 comprises projectable elements 33 having a piston part 35 slideable in a second side channel 34 of the central bore 29 of the closing member 23. The fluid pressurises from within the central bore of the closing member 23, and the piston part 35 is forced against the inner surface of the bore 28 of the housing 20. When the closing member 23 is in its closed position, the projectable elements 33 are opposite a circumferential groove 42 in the bore 28 of the housing 20. When being opposite the groove 42, the projectable elements 33 are then capable of entering the groove 42, and the spring member 24 then presses the closing member 23 towards the inlet opening 22 and thus maintains the projectable elements 33 in engagement with the groove 42. As a result, the device is closed and the leaking annular barrier does no longer prevent the other annular barriers from being expanded. Since this closing of the device occurs almost instantly when the leak occurs, the expansion process is not slowed down.

Figure 5A:
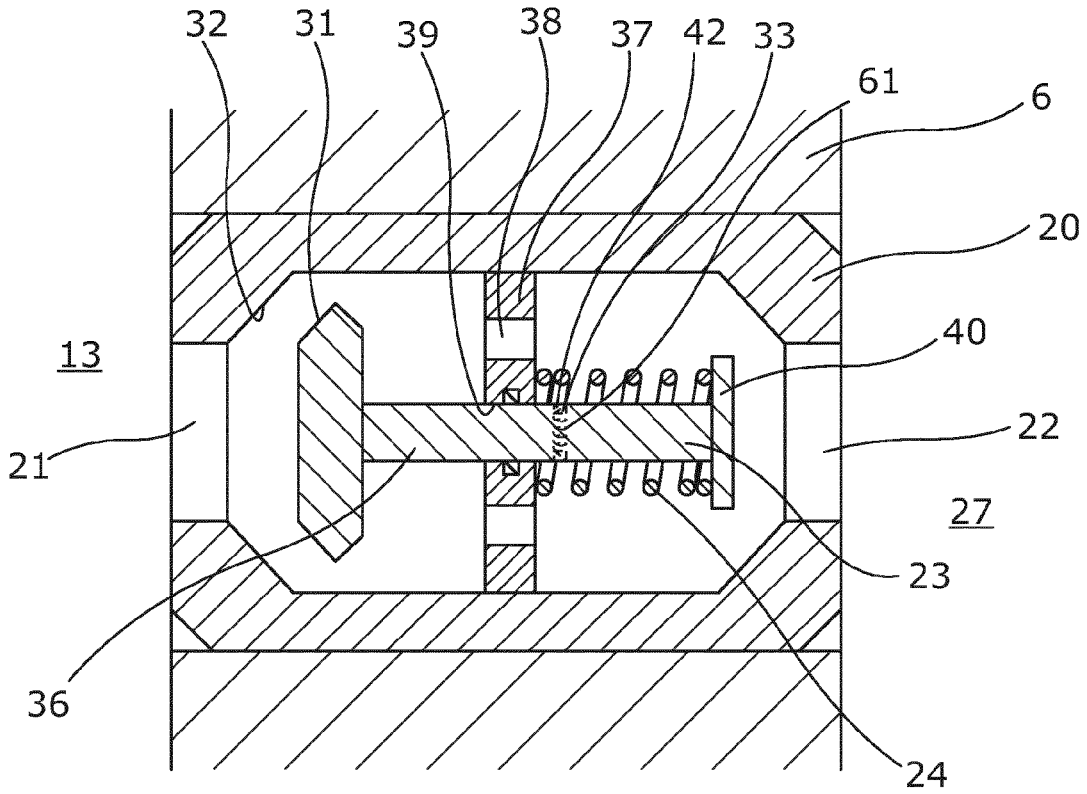
FIG. 5*a* shows a cross-sectional view of another embodiment of the device in an open position.
Figure 5B:
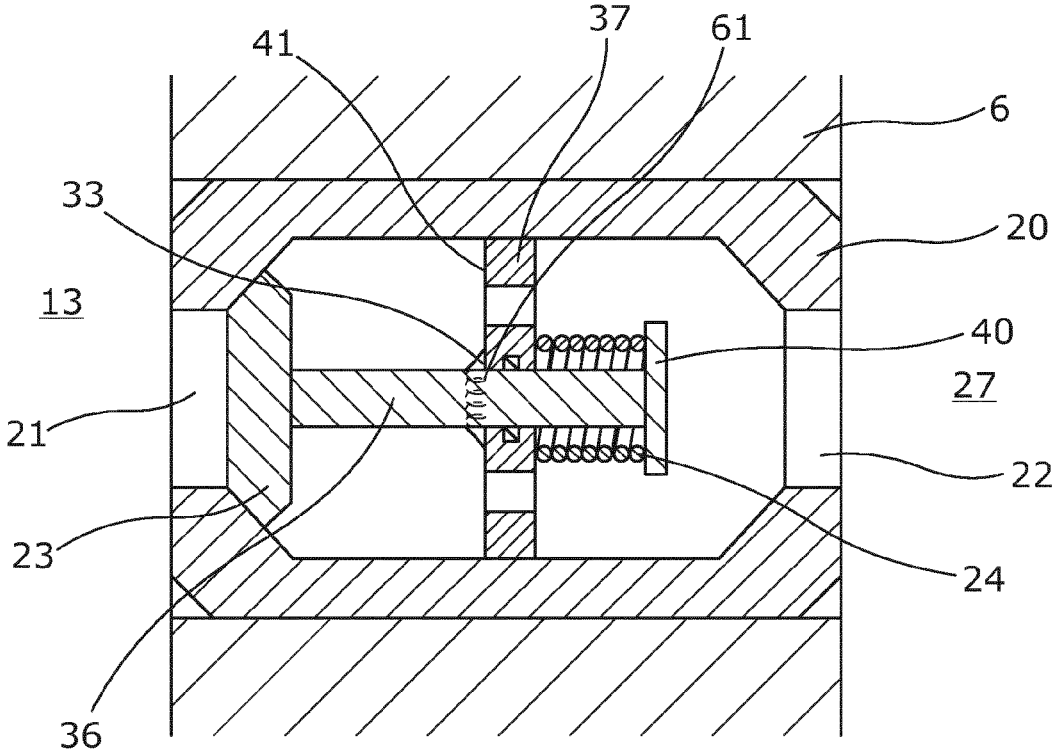
FIG. 5*b* shows a cross-sectional view of the device of FIG. 5*a* in a closed position.

In the device of FIGS. 5*a* and 5*b*, the closing member 23 comprises a rod 36 or a shaft penetrating a partition 37 in the housing of the device. The partition has openings 38 and a bore 39 through which the rod extends. The rod 36 ends in an end member 40 having a larger diameter than that of the rod, and the spring member 24 is arranged between the partition and the end member 40. In FIG. 5*a*, the device is shown in its open position in which the spring member 24, arranged between the end member 40 and the partition 37, forces the closing member 23 towards the inlet opening 22. In the open position, fluid enters from the interior 27 of the tubular part 6 through the inlet opening 22 of the housing 20 and through the openings 38 in the partition 37 and further past the front end 31 of the closing member 23 and out of the outlet opening 21 into the space 13. When the flow rate through the closing member exceeds a predetermined level, the fluid flow presses the closing member 23 towards the outlet opening 21 and thus closes the device as the front end 31 is being pressed against the seat 32 of the housing.

As can be seen in FIG. 5*b*, in which the device of FIG. 5*a* is closed, the rod 36 of the closing member 23 comprises at least one projectable element 33 to lock the closing member when the closing member is in the closed position of the device, preventing the closing member from returning to the open position. The projectable elements 33 engage with the end face 41 of the partition and are released when they pass the bore of the partition, and when the projectable elements 33 are projected to extend above part of the partition, the projectable elements 33 are prevented from entering into the grooves 42 in the rod 36 as the spring member 24 presses the projectable elements 33 towards the partition. The projectable elements 33 are forced outwards by means of a second spring member 61 arranged in the rod between the projectable elements 33.

In FIGS. 3*b* and 3*c*, the device has an indication 45 of a position of the closing member 23. The indication 45 is a projection 45 of the closing member which projects from the inner wall 46 of the tubular part 6 when the device is open, and when the device is closed, the projection 45 is positioned in the aperture 11 so that it no longer projects from the inner wall 46 into the interior 27 of the tubular part 6.

Figure 6:
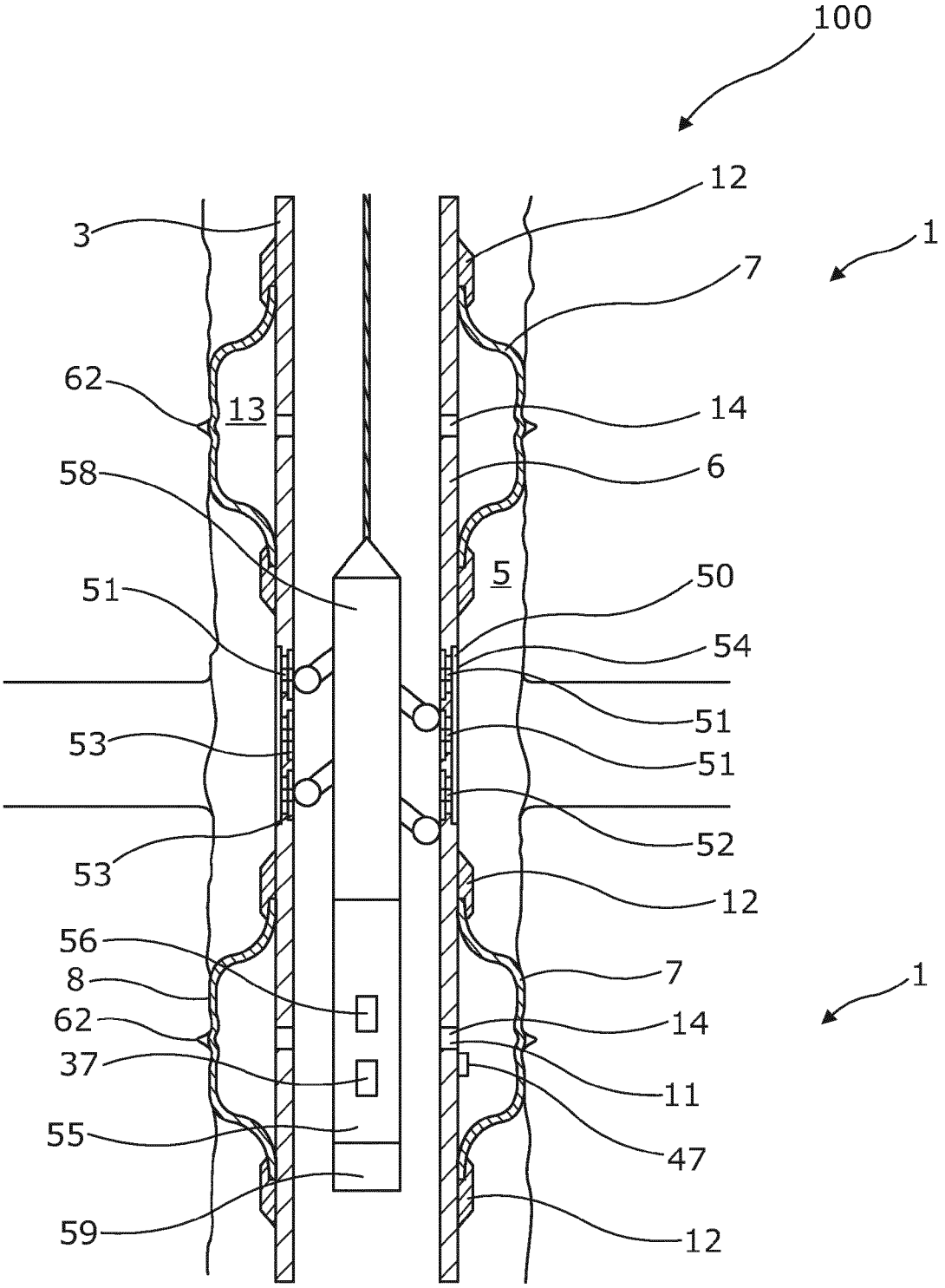
FIG. 6 shows a downhole system having a plurality of annular barriers.

As shown in FIG. 6, the device further comprises a pressure sensor 47 arranged in the space 13 in order to close the outlet opening of the device when the pressure of the fluid drops below a predetermined level.

The annular barrier may also comprise a seismic sensor, a sound sensor or another type of acoustic sensor for detecting another sound pattern due to a leak when the expandable sleeve bursts or cracks. The seismic sensor, sound sensor 62 or other type of acoustic sensor may be arranged on the outer face 8 of the expandable sleeve as shown in FIG. 6.

Figure 7A:
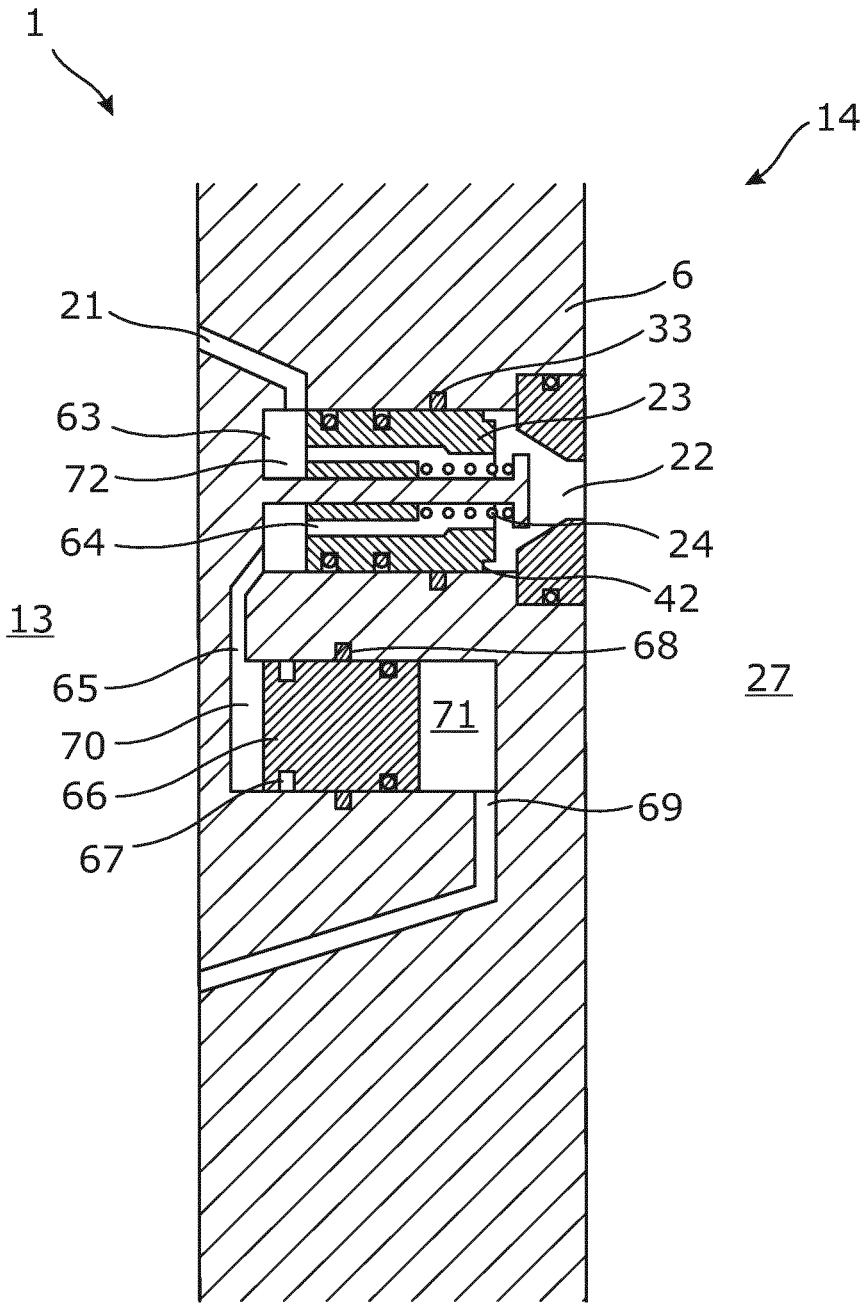
FIG. 7*a* shows another embodiment of the self-actuated device in an open position.
Figure 7B:
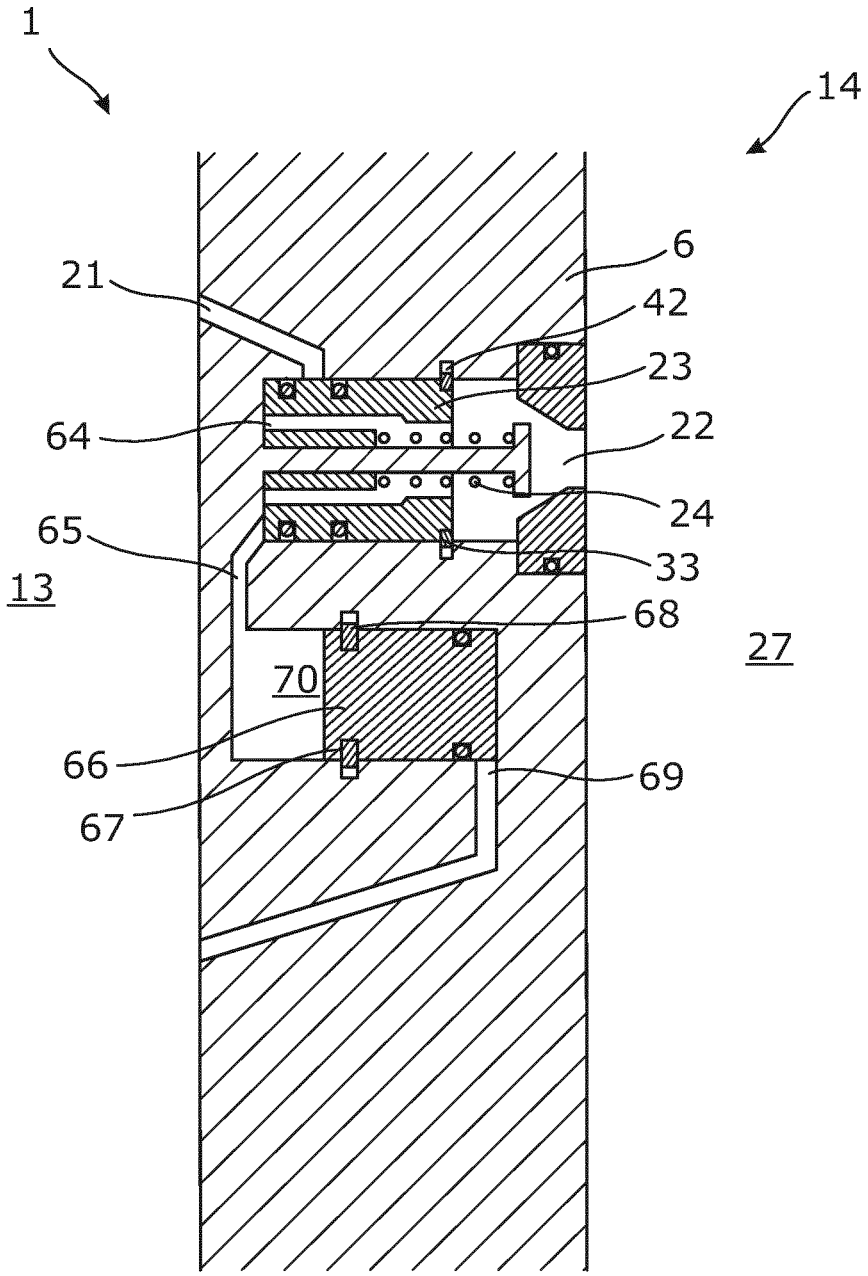
FIG. 7*b* shows the self-actuated device of FIG. 7*a* in a closed position.

In FIG. 7*a*, the self-actuated device 14 is arranged in a first bore 63 of the tubular part of the annular barrier. The closing member 23 is arranged in the first bore 63 and between a centre part 64 of the housing, and the closing member 23 of the spring member 24 is arranged to force the closing member towards the outlet opening 21 and thus the self-actuated device into its open position. In the open position, the fluid flows through channels 64 in the closing member towards the outlet opening and into the space 13 to expand the sleeve. In the event that the sleeve bursts or leaks, the closing member 23 moves to close the outlet opening as shown in FIG. 7*b*, and the projectable element 33 engages a groove 42 in the end of the closing member facing the inlet opening 22. When moving into the closed position, the closing member displaces a volume 72 of fluid (shown in FIG. 7*a*) and this volume of fluid enters an outlet channel 65 and into a second bore 70, moving a compensating piston 66 towards the inside of the tubular structure.

The compensating piston 66 displaces a second volume 71 of fluid corresponding to the volume 72 displaced by the closing member in the first bore. The second volume of fluid is fluidly connected with the space 13 through an outlet channel 69. The trapped volume 72 shown in FIG. 7*a* is thus compensated by the compensating piston displacing the same volume in the second bore 70.

The device may be a valve which may be an excess-flow check valve, a mechanical valve closing at a flow rate higher than a predetermined flow rate, a shut-off valve, or a differential pressure shut-off valve.

The mechanical valve is biased towards the open position. It is manufactured having a pre-set via the internal spring force to close at a predetermined flow rate higher than normal expected flow rates. This flow rate is also referred to as the "Cut-Off" flow rate. Under normal flow rate conditions, the device remains in the open position, offering minimal flow resistance being a pressure differential across the device.

Should the flow rate through the device exceed the pre-set "Cut-Off" flow rate due to fracture, rupture or failure in the expandable sleeve, the device automatically closes and stops the flow.

The invention further relates to a downhole system 100 comprising a plurality of annular barriers 1 as shown in FIG. 6. The system 100 further comprises the well tubular structure 3 having a valve section 50 arranged between two annular barriers for letting hydrocarbon-containing fluid into the well tubular structure 3 and up through the production casing 3. The valve section 50 has inflow control valves 51 and a fracturing opening or a fracturing valve 52. A screen 54 may be arranged opposite the valves in a recess on the outer face of the well tubular structure 3. Opposite the valve, a plurality of sliding or rotational sleeves 53 are arranged to close off the valve while the well tubular structure is being pressurised.

The downhole system further comprises a detection tool 55 for determining the position of the valve after expansion of the annular barrier. Furthermore, the tool comprises a pressure sensor 56 and a capacitance measuring unit 57 in order to sense the flow situation around the valve in the aperture of the annular barriers. The pressure sensor is capable of determining the pressure in the space and the capacitance measuring unit 57 by creating a tomography capable of logging if there is a flow change around the valve. If the flow changes around the valve and the pressure in the space decreases after the expansion has ended, the expandable sleeve of the annular barrier is leaking without the valve having closed. The tool may therefore comprise replacement means 59 for replacing the valve, e.g. taking out the broken valve and replacing it with a dummy valve so that the aperture of the tubular part 6 of the annular barrier 1 is firmly closed.

By having an indication of the closed position of the valve, the detection tool may also confirm that a valve has been closed and that the annular barrier has most likely not been set properly due to a fracture in the expandable sleeve.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a driving unit 58, such as downhole tractor, can be used to push the tools all the way into position in the well. A downhole tractor is any kind of driving tool capable of pushing or pulling tools in a well downhole, such as a Well Tractor®. The downhole tractor may have hydraulically-driven wheels arranged on projectable arms.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole downhole, comprising a tubular part for mounting as part of the well tubular structure, said tubular part having a longitudinal axis, an expandable sleeve surrounding the tubular part and having an outer face, each end of the expandable sleeve being fastened to the tubular part by means of a connection part, an annual barrier space between the tubular part and the expandable sleeve, an aperture in the tubular part or the connection part for letting fluid into the space in order to expand the sleeve, and a self-actuated device arranged in the aperture and movable between an open position and a closed position, the self-actuated device comprising a housing having an outlet opening and an inlet opening, a closing member and a spring member arranged to force the self-actuated device in the open position, so that fluid let into the space is capable of flowing in through the inlet opening and out through the outlet opening into the space, wherein the self-actuated device comprises at least one projectable element to lock the closing member when the device is in the closed position, preventing the device from returning to the open position.

2. The annular barrier according to claim 1, wherein the spring member is a spring, a helical spring, an elastomeric element or a rubber element.

3. The annular barrier according to claim 1, wherein the self-actuated device is structured to close when a flow rate of fluid through the device exceeds a predetermined flow rate.

4. The annular barrier according to claim 3, wherein the self-actuated device has an indication of a position of the closing member.

5. The annular barrier according to claim 1, wherein the self-actuated device is structured to close when a pressure of fluid through the device drops below a predetermined level.

6. The annular barrier according to claim 1, wherein the self-actuated device further comprises a pressure sensor arranged in the space in order to close the outlet opening of the device when the pressure of the fluid drops below a predetermined level.

7. The annular barrier according to claim 1, wherein the self-actuated device is a valve, an excess-flow check valve, a mechanical valve closing at a flow rate higher than a predetermined flow rate, a shut-off valve, or a differential pressure shut-off valve.

8. The annular barrier according to claim 1, further comprising a sensor arranged on the outer face of the expandable sleeve.

9. The annular barrier according to claim 8, wherein the sensor is a sound detection sensor.

10. The annular barrier according to claim 8, wherein the sensor is wirelessly connected with the self-actuated device.

11. The annular barrier according to claim 1, wherein the self-actuated device comprises a second bore having a compensating piston.

12. The annular barrier according to claim 1, wherein the projectable element engages a groove in the closing member or the housing for locking the closing member.

13. The annular barrier according to claim 1, wherein the projectable element engages an end face of a partition for locking the closing member.

14. A downhole system comprising a plurality of annular barriers according to claim 1.

15. The downhole system according to claim 14, further comprising a detection tool for determining the position of the device after expansion of the annular barrier.

16. The downhole system according to claim 15, wherein the tool comprises a pressure sensor.

17. The downhole system according to claim 15, wherein the tool comprises a capacitance measuring unit.

18. The downhole system according to claim 15, wherein the tool comprises a driving unit, or a downhole tractor.

19. The downhole system according to claim 15, wherein the tool comprises replacement structure to replace the device in the annular barrier.

20. The downhole system according to claim 14, further comprising the well tubular structure having a valve section arranged between two annular barriers in order to let hydrocarbon-containing fluid into the well tubular structure.

* * * * *